US007954186B2

(12) United States Patent
Flick

(10) Patent No.: US 7,954,186 B2
(45) Date of Patent: Jun. 7, 2011

(54) INFLATABLE MATTRESS WITH UNIFORM RESTRAINT

(75) Inventor: Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 524 days.

(21) Appl. No.: 11/823,513

(22) Filed: Jun. 28, 2007

(65) Prior Publication Data

US 2008/0271245 A1 Nov. 6, 2008

Related U.S. Application Data

(60) Provisional application No. 60/927,577, filed on May 4, 2007.

(51) Int. Cl.
*A47C 21/08* (2006.01)

(52) U.S. Cl. ..... 5/425; 5/713; 5/424

(58) Field of Classification Search ..... 5/713–715, 5/726, 424–425
See application file for complete search history.

(56) References Cited

U.S. PATENT DOCUMENTS

| | | | | |
|---|---|---|---|---|
| 529,852 | A | 11/1894 | Brupbacher | |
| 1,276,361 | A | 8/1918 | Hobert | |
| 1,528,066 | A | 3/1925 | McEntire | |
| 3,513,489 | A | 5/1970 | Miller et al. | |
| 4,051,566 | A | 10/1977 | Esquivel | |
| 4,280,487 | A | 7/1981 | Jackson | |
| 4,803,744 | A * | 2/1989 | Peck et al. | 5/713 |
| 4,872,228 | A | 10/1989 | Bishop | |
| 4,934,002 | A | 6/1990 | Watanabe | |
| 4,947,500 | A * | 8/1990 | Seiler | 5/713 |
| 4,991,244 | A | 2/1991 | Walker | |
| 5,070,560 | A | 12/1991 | Wilkinson | |
| 5,107,558 | A | 4/1992 | Luck | |
| 5,140,309 | A | 8/1992 | Gusakov | |
| 5,249,318 | A | 10/1993 | Loadsman | |
| 5,765,246 | A | 6/1998 | Shoenhair | |
| 5,794,289 | A * | 8/1998 | Wortman et al. | 5/713 |
| 5,822,817 | A | 10/1998 | Carew et al. | |
| 5,901,393 | A | 5/1999 | Pepe et al. | |
| 5,926,883 | A | 7/1999 | Rechin et al. | |

(Continued)

*Primary Examiner* — Fredrick Conley
(74) *Attorney, Agent, or Firm* — Van Dyke, Gardner, Linn & Burkhart, LLP

(57) ABSTRACT

A cushioning device having a first deep cell inflatable bladder, a first restraint structure, a pump and an attachment. The first deep cell inflatable bladder has a first side, a second side, an upper surface and a lower surface. The first restraint structure has a top surface and a bottom surface. The pump has (a) a maximum inflation mode that inflates the first deep cell inflatable bladder so the bladder's upper surface and the first restraint's top surface are in or approximately in the same plane and (b) a normal operating inflation mode that provides sufficient inflation to (A) prevent the first bladder's upper surface from contacting the first bladder's lower surface, (B) decrease (i) the formation of debuticus ulcers on a patient and (ii) the patient's tissue interface pressure, and (C) allow the restraint structure to inhibit and/or restrain the patient from rolling off the first deep cell inflatable bladder. The attachment attaches at least a portion of the first bladder's first side to the first restraint structure at a predetermined distance below the first restraint's top surface so (A) the first restraint during the normal operating mode inhibits and/or restrains the patient from rolling off the first deep cell inflatable bladder, and (B) the first restraint and first deep cell inflatable bladder provide lateral stability to allow the patient to get in and out of the cushioning device and facilitating patient transfers during the maximum inflate mode.

20 Claims, 5 Drawing Sheets

U.S. PATENT DOCUMENTS 5,937,465 A 8/1999 Carew et al.
5,963,998 A 10/1999 Carew et al.
5,966,763 A 10/1999 Thomas et al.
6,073,291 A 6/2000 Davis
6,079,070 A 6/2000 Flick
6,223,369 B1 5/2001 Maier et al.
6,493,888 B1 12/2002 Salvatini et al.
6,523,198 B1 2/2003 Temple
6,604,252 B1 8/2003 Lee et al.
6,735,800 B1 5/2004 Salvatini et al.
6,739,001 B2 5/2004 Flick et al.
6,767,621 B2 * 7/2004 Flick et al. ..... 428/306.6
6,782,574 B2 8/2004 Totton et al.
6,813,790 B2 11/2004 Flick et al.
6,859,967 B2 3/2005 Harrison et al.
6,912,743 B1 7/2005 Weil
7,007,330 B2 3/2006 Kuiper et al.
7,111,348 B2 9/2006 Ellis et al.
7,127,755 B1 10/2006 Stacy et al.
7,155,766 B1 1/2007 Gilchrest, Jr. et al.
7,197,780 B2 4/2007 Petric
7,203,984 B2 4/2007 Gardner et al.
7,296,315 B2 11/2007 Totton et al.
7,322,947 B2 1/2008 Flick et al.
7,380,302 B2 6/2008 Gilchrest, Jr. et al.
7,441,290 B1 10/2008 Flick
7,681,269 B2 3/2010 Biggie et al.
7,735,171 B2 6/2010 Kan
2003/0188388 A1 10/2003 Boso et al.
2003/0192127 A1 10/2003 Cook et al.
2004/0134433 A1 7/2004 Holder
2005/0081300 A1 4/2005 O'Reagan et al.
2006/0016016 A1 1/2006 Hornbach
2006/0090264 A1 5/2006 Boyd
2006/0101581 A1 5/2006 Blanchard et al.
2006/0272097 A1 12/2006 Dionne et al.
2007/0143928 A1 6/2007 Biggie et al.
2007/0234480 A1 10/2007 Crousore et al.
2007/0234481 A1 10/2007 Totton et al.
2007/0251012 A1 11/2007 Hill
2008/0271245 A1 11/2008 Flick
2009/0193580 A1 8/2009 Gauger
2010/0071137 A1 3/2010 Doehler et al.

* cited by examiner

INFLATABLE MATTRESS WITH UNIFORM RESTRAINT

CLAIM OF PRIORITY

This application claims priority to U.S. provisional patent application Ser. No. 60/927,577, filed on May 4, 2007.

FIELD OF THE INVENTION

The present invention relates to a cushioning device, such as an overlay for a mattress, which includes an integrated restraint structure.

BACKGROUND OF THE INVENTION

Flick et al. disclose in U.S. Pat. No. 6,739,001 a mattress system 10 having a fluid cushion 12 connected to a first restraint 14 and a second restraint 16 positioned on a patient support device 17 (i.e., a bed frame) with railings 18 as illustrated in FIG. 1.

The fluid cushion 12 has a head end 20, a foot end 22, a middle area 24, a right side 26, a left side 28, a top surface 30 and a bottom surface 32. The fluid cushion can be a plurality of air bladders, an air bladder with interior welds, low loss air bladders with or without interior welds, or any other conventional fluid cushion material. Examples of such cushions include and are not limited to Gaymar Industries, Inc.'s Airflo pad, Paradise pad, and Aire-Twin mattress bladders.

The first restraint 14 is positioned on the cushion's right side 26 and the second restraint 16 is positioned on the cushion's left side 28. Respectively, the restraints 14, 16 can (a) extend the entire length of the right side 26 and left side 28 as illustrated in FIG. 2; or (b) be positioned at (i) the head end on both sides 26, 28 as illustrated in FIG. 3; (ii) the foot end on both sides 26, 28 as illustrated in FIG. 4; or (iii) the head end and the foot end on both sides 26, 28 with no restraints at the middle area 24 as illustrated in FIG. 5. The last embodiment was desired to allow the patient a path to egress from the cushion 12.

The restraints 14, 16 have a top surface 50, a bottom surface 52, an interior surface 54 and an exterior surface 56. The restraints 14, 16 can be fluid bladders, foam, foam beads, gels, batting, or other suitable materials for inhibiting and/or restraining a user from rolling (a) off the long term support device 17 and/or (b) into the area between the fluid cushion 12 and the railing 18. What ever the restraint material, the restraints 14, 16 are attached and/or interconnected to the cushion 12 to ensure the restraints perform as a restraint.

Where the cushion attaches and/or interconnects to the restraints is a critical issue. Flick et al. explicitly disclose the cushion's top surface 30 is always below the restraint's top surface 50.

Gaymar Industries, Inc. has learned that a restraint makes it difficult to transfer a patient. Many individuals complain about lifting a patient over the restraint member.

For a number of years, Gaymar has been manufacturing its Sof-Matt RSM Low-Air-Loss Mattress System as illustrated in FIGS. 6*a*, 6*b* and 7. That mattress system has foam crib 60 surrounding a plurality of deep cell air bladders 62 interconnected to an air pump (not shown). Deep cell air bladders are a minimum of 5 inches tall. The foam crib 60 has a top surface 64. The air bladder 62 also has a top surface 66 and interconnects 68 to the foam crib 60 at and/or near the bladder's top surface 66 to the restraint's top surface 64 as illustrated in FIG. 6. That interconnection 68 position was deemed critical to provide lateral stability to the mattress system to make it easier for the patient to get in and out of bed and facilitating patient transfers.

The air pump provides air to the air bladder at least at two different inflation modes. The first inflation mode is referred to as maximum volume. At maximum volume, the air bladder's top surface 66 is planar to the crib's top surface 64 as illustrated in FIG. 6*a*. The second inflation mode, as illustrated in FIG. 7, is referred to as normal operating mode. Normal operating mode provides sufficient inflation to prevent the patient from bottoming out when not desired and sufficient pressure to decrease the formation of debuticus ulcers. ("Bottoming" refers to any state where the bladder's top surface 66 is depressed to a point that it contacts the bladder's lower surface 67, thereby markedly increasing the interface pressure where the two surfaces contact each other and is not desired unless CPR needs to be administered.) The normal operating mode in the current embodiment of Gaymar's Sof-Matt RSM Low-Air-Loss Mattress System creates a hammock effect. The hammock effect increases tissue interface pressure, which is normally undesirable. Since the crib and bladders only form a hammock effect in the normal operating mode, the crib in Gaymar's Sof-Matt RSM Low-Air-Loss Mattress System is not a restraint because the patient can roll (a) off the patient support device 17 or (b) into a position between the crib and the bed railing. Obviously these results are undesirable.

SUMMARY OF THE INVENTION

A cushioning device having a first deep cell inflatable bladder, a first restraint structure, a pump and an attachment. The first deep cell inflatable bladder has a first side, a second side, an upper surface and a lower surface. The first restraint structure has a top surface and a bottom surface. The pump has (a) a maximum inflation mode that inflates the first deep cell inflatable bladder so the bladder's upper surface and the first restraint's top surface are in or approximately in the same plane and (b) a normal operating inflation mode that provides sufficient inflation to (A) prevent the first bladder's upper surface from contacting the first bladder's lower surface, (B) decrease (i) the formation of debuticus ulcers on a patient and (ii) the patient's tissue interface pressure, and (C) allow the restraint structure to inhibit and/or restrain the patient from rolling off the first deep cell inflatable bladder. The attachment attaches at least a portion of the first bladder's first side to the first restraint structure at a predetermined distance below the first restraint's top surface so (A) the first restraint during the normal operating mode inhibits and/or restrains the patient from rolling off the first deep cell inflatable bladder, and (B) the first restraint and first deep cell inflatable bladder provide lateral stability to allow the patient to get in and out of the cushioning device and facilitating patient transfers during the maximum inflate mode.

DETAILED DESCRIPTION OF THE INVENTION

Figure 1:
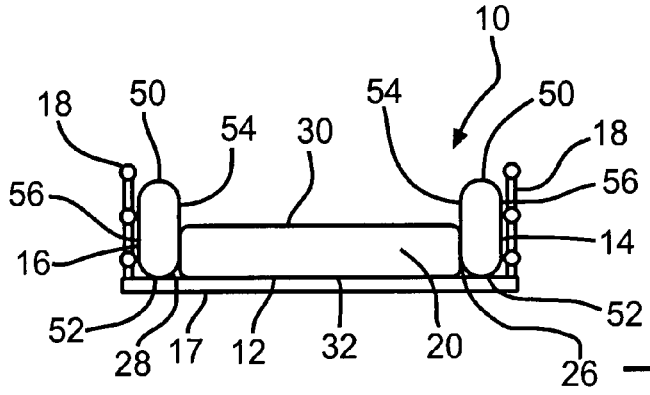
FIG. 1 (Prior Art)
FIG. 1 illustrates a side view of a first prior art mattress system having restraints.
Figure 2:
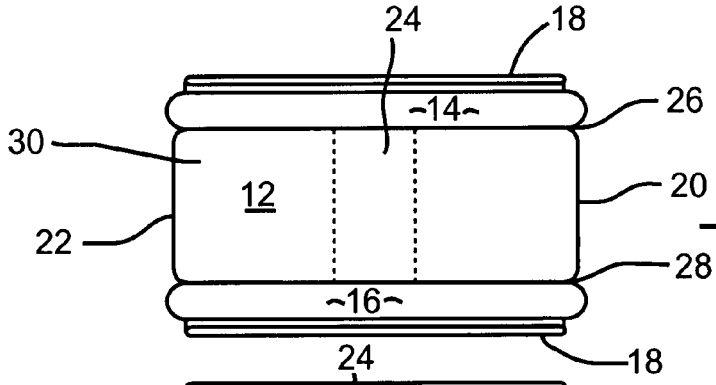
FIG. 2 (Prior Art)
FIG. 2 is a top view of FIG. 1.
Figure 3:
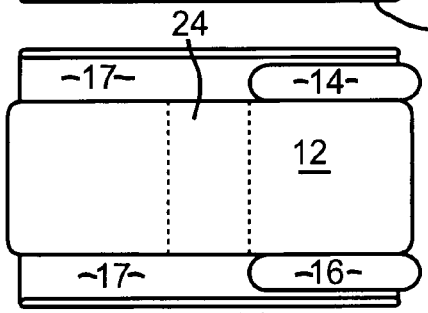
FIG. 3 (Prior Art)
FIGS. 3 to 5 are alternative embodiment of FIG. 2.
Figure 4:
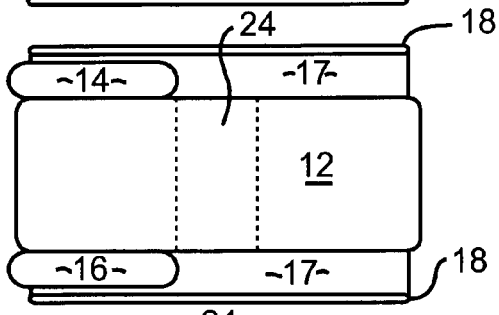
FIG. 4 (Prior Art)
Figure 5:
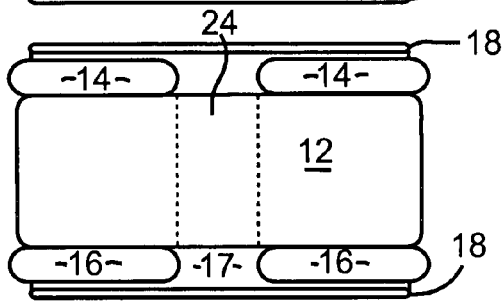
FIG. 5 (Prior Art)
Figure 6A:
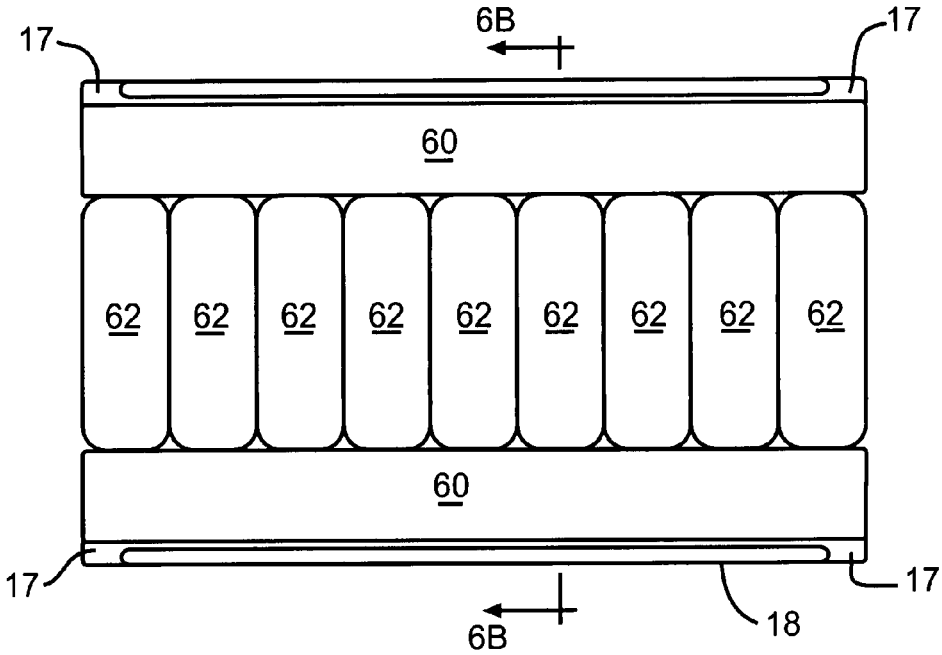
FIG. 6A (Prior Art)
FIG. 6*a* is a top view of a second prior art mattress system of a crib surrounding air bladders at maximum inflation mode.
Figure 6B:
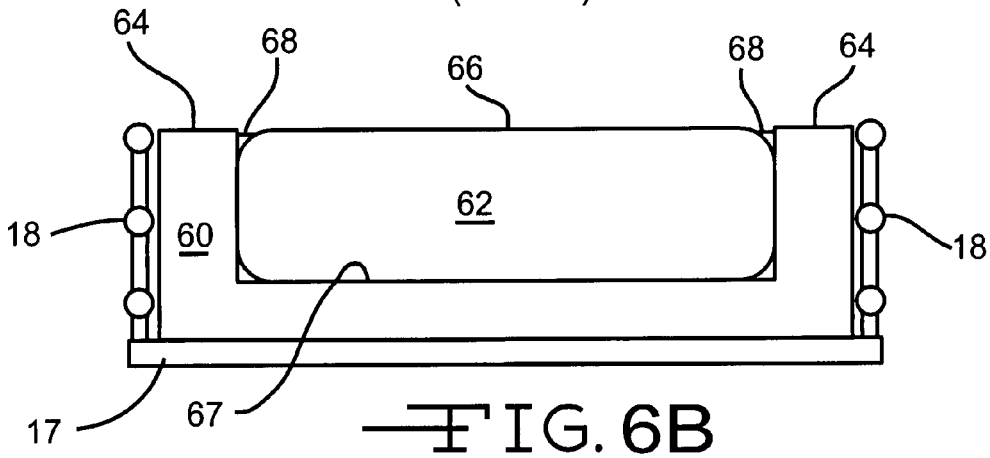
FIG. 6B (Prior Art)
FIG. 6*b* is a cross-sectional view of FIG. 6*a* taken along the lines 6*b*-6*b*.
Figure 7:
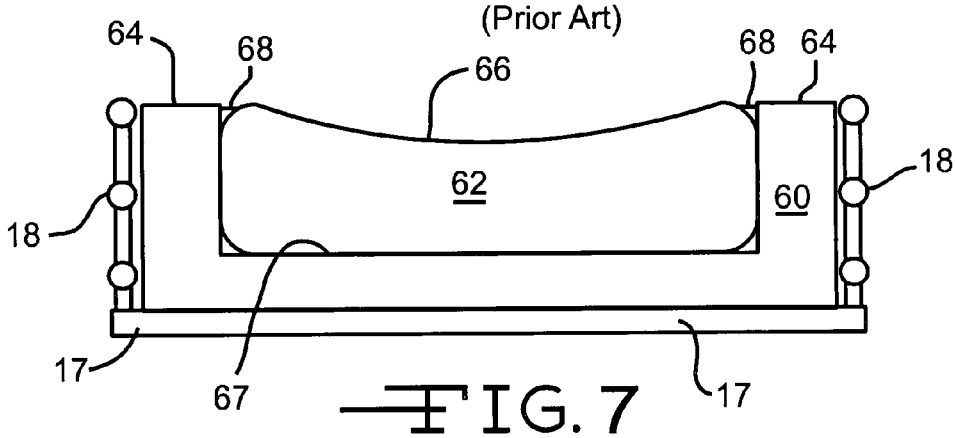
FIG. 7 (Prior Art)
FIG. 7 is an alternative embodiment of FIG. 6 at normal operating inflation mode.
Figure 8:
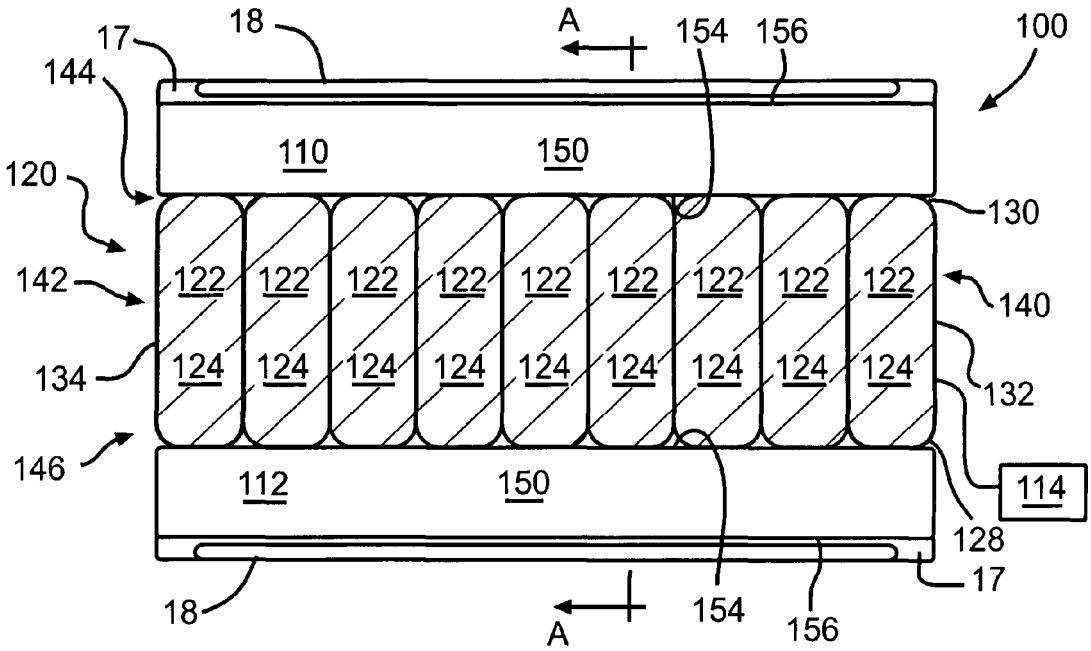
FIG. 8 illustrates a top plan view of the current invention.

FIG. 8 illustrates a restraint/cushioning system 100. The restraint/cushioning system 100 has a first restraint 110, a second restraint 112, a fluid pump 114 and a cushioning section 120.

Figure 9:
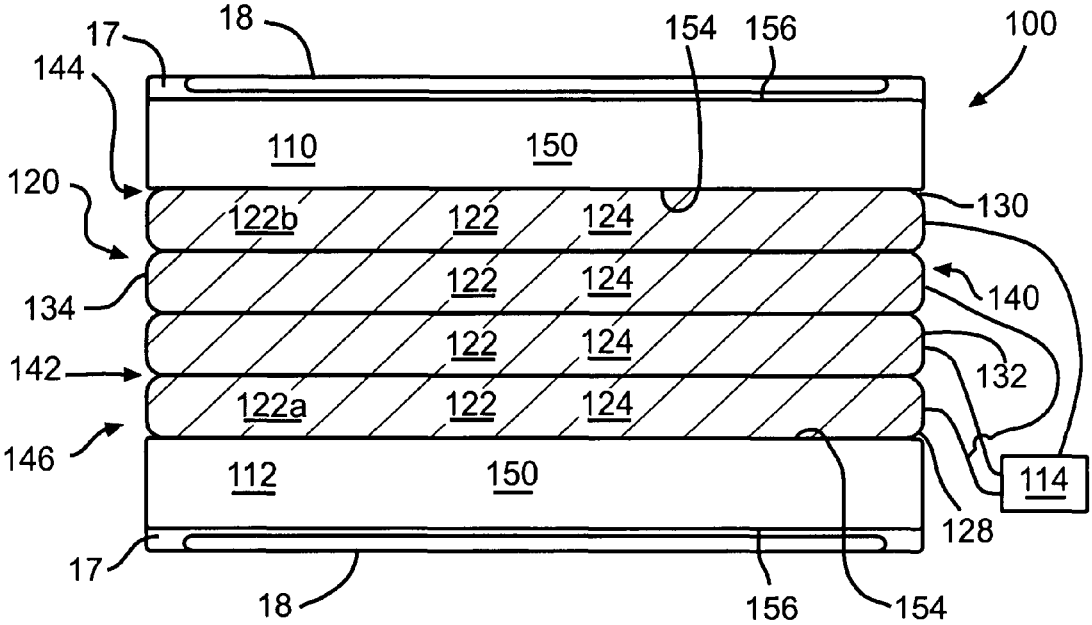
FIG. 9 illustrates a top plan view of an alternative embodiment of FIG. 8.

The cushioning section 120 has at least one inflatable bladder 122. Each inflatable bladder 122 has a top surface 124, a bottom surface 126, a left side 128, a right side 130, a head side 132, and a foot side 134. There can be one bladder (FIG. 10) or numerous bladders to form the cushioning section. Preferably there are numerous bladders. If numerous bladders are used, the bladders 122 are lined from the cushioning section's 120 head section 140 to foot section 142 as illustrated in FIG. 8 or from the cushioning section's 120 right side 144 to left side 146 as illustrated in FIG. 9. In any embodiment, each bladder 122 is made of three layers of suitable puncture-resistant vinyl film or other suitable air impervious flexible material. However, the bladder may be made of two layers of air impervious flexible material, if desired.

The inflatable bladder 122 is a deep cell inflatable bladder. A deep cell inflatable bladder is preferably at a minimum five inches in height.

Figure 10:
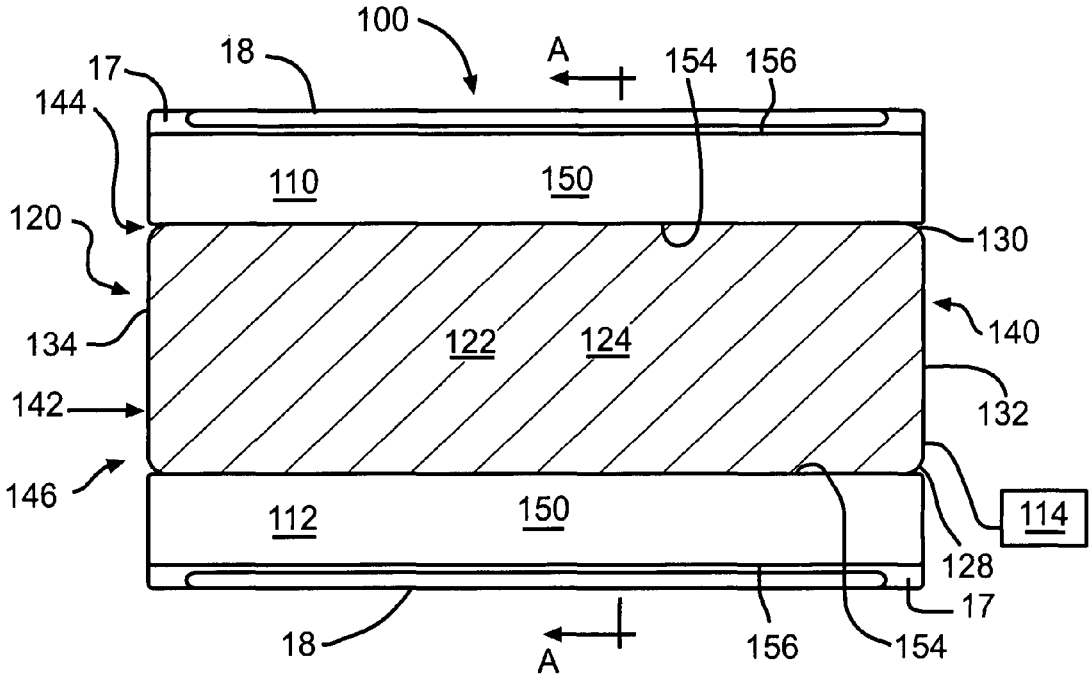
FIG. 10 illustrates a top plan view of an alternative embodiment of FIG. 8.
Figure 11:
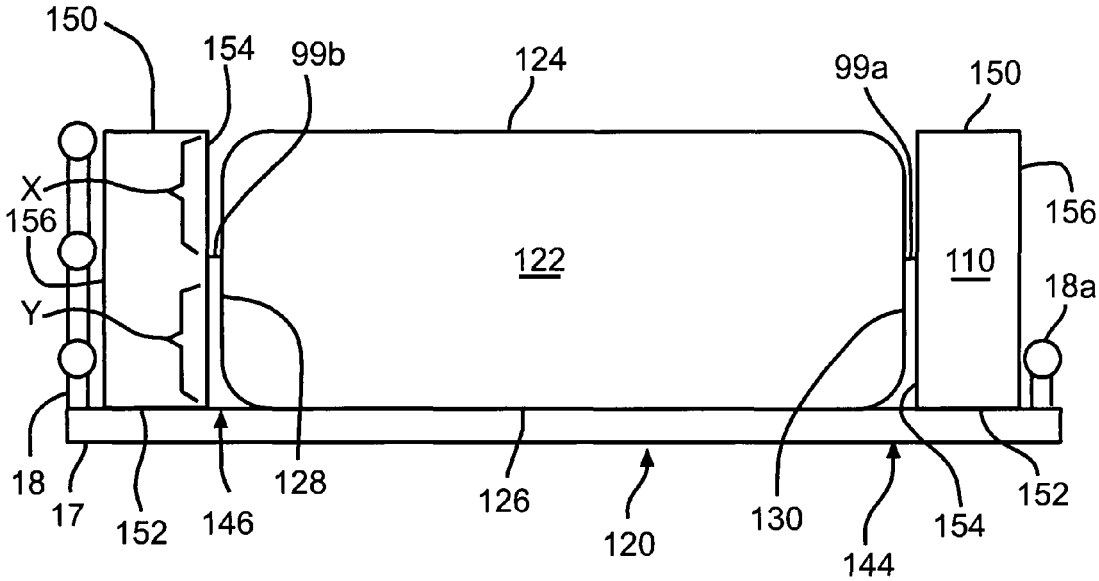
FIG. 11 illustrates a cross-sectional view of FIG. 8 taken along the lines A-A when the pump is in maximum inflation mode.
Figure 12:
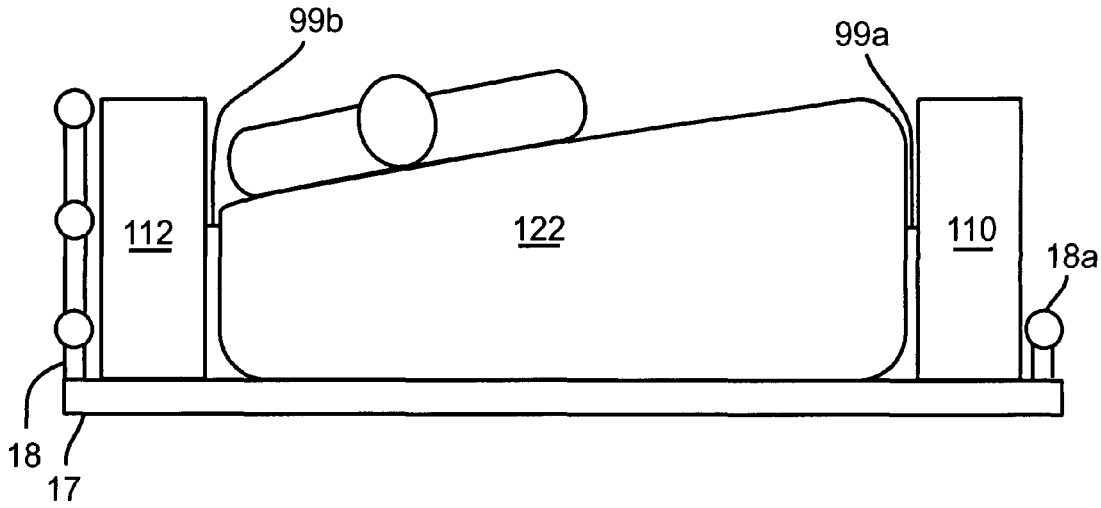
FIG. 12 illustrates a cross-sectional view of FIG. 8 taken along the lines A-A when the pump is in normal operation mode.
Figure 13:
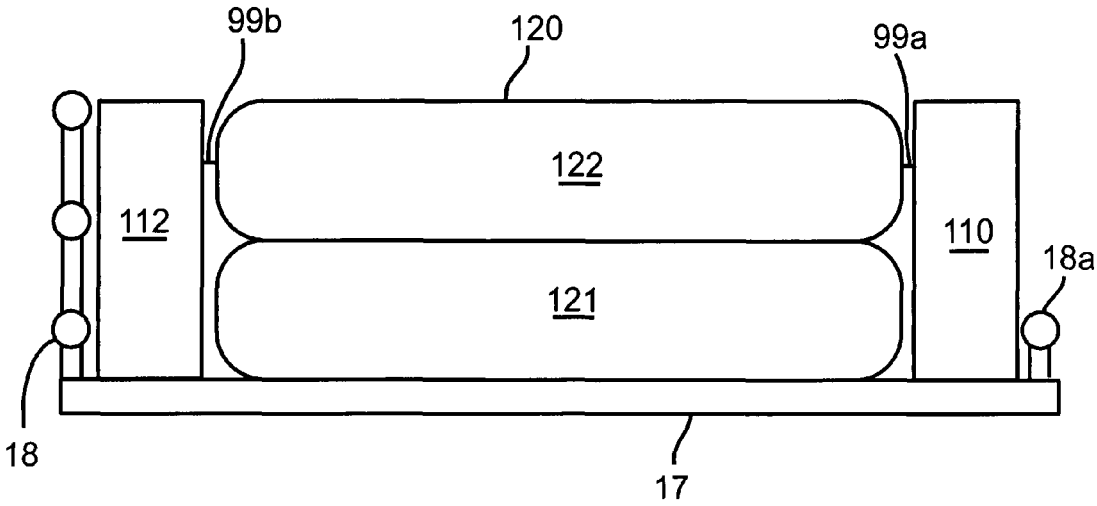
FIG. 13 illustrates an alternative embodiment of FIG. 11.

The first restraint 110 is positioned adjacent to and attached 99*a* to the cushioning section's right side 144 and the second restraint 112 is positioned adjacent to and attached 99*b* to the cushion's left side 146, as best seen at FIGS. 11 to 13. In particular, the FIG. 8 embodiment has every bladder's 122 (a) left side 128 attached 99*b* to the second restraint 112 and (b) right side 130 attached 99*a* to the first restraint 110. The FIG. 9 embodiment has the "bladder positioned adjacent to the second restraint" 122*a* attached 99*b* to the second restraint 112 at intermittent locations that are separated by distances about equal to the width of the bladders 122, and the "bladder positioned adjacent to the first restraint" 122*b* attached 99*a* to the first restraint 110 at intermittent locations that are separated by distances about equal to the width of the bladders 122. The FIG. 10 embodiment has the left side 146 attached 99*b* to the second restraint 112 at intermittent locations that are separated by distances about equal to the width of the bladders 122 illustrated in FIGS. 9 and 10, and the right side 144 is attached 99*a* to the first restraint 110 at intermittent locations that are separated by distances about equal to the width of the bladders 122 illustrated in FIGS. 9 and 10.

The restraints 110, 120 extend the entire length of the right side 144 and left side 146 as illustrated in FIGS. 8, 9, and 10. The restraints 110, 120 have a top surface 150, a bottom surface 152, an interior surface 154 and an exterior surface 156. The restraints 110, 120 can be fluid bladders, foam, foam beads, gels, batting, or other suitable materials for restraining a user. What ever the restraint material, the restraints 110, 120 are attached and in some case fluidly interconnected to the cushioning section 120. The restraints can be covered by a conventional impermeable, medically accepted cover. Preferably the restraints are foam like materials surrounded by a cover and portions of the restraint (or restraint's cover) attaches to each bladder 120.

The bladder 122 and the restraints 110, 112 are attached 99 (a) directly to each other through heat welding, sonic welding, stitching or other conventional attachment methods used in the mattress industry or (b) indirectly to each other for example through a strap. The strap has a first end and a second end. The first end attaches to the bladder 122 and the second end attaches to the respective restraints 110, 120. The straps are attached to the bladder or restraints through heat welding, sonic welding, stitching, other conventional attachment methods used in the mattress industry or combinations thereof. The attachment 99 should be sufficient to withstand the pressures applied by a patient positioned on the restraint/cushioning system 100 and the internal pressure provided by the fluid pump 114.

The fluid pump 114 inflates the bladders through at least two inflation modes. The first inflation mode is maximum inflate. Maximum inflate means every bladder 122 is fully inflated which results in every bladder's top surface 124 being on or within approximate area of the same plane as the restraint's top surface 150 as illustrated in FIG. 11. The maximum inflate is used when the patient is being transferred by patient assistants or the patient is authorized to egress from the restraint/cushioning system 100.

The second inflation mode is the normal operating mode. The normal operating mode provides sufficient inflation to prevent the patient from bottoming out and sufficient pressure to decrease (a) the formation of debuticus ulcers and (b) the tissue interface pressure. The tissue interface pressure decreases because the hammock effect is avoided.

The hammock effect is avoided and the restraints perform as restraints when the pump is in the normal operating mode, which involves attaching 99 the bladder 122 to each restraint's 110, 112 interior surface 154 at a first predetermined distance (x) below the restraint's top surface 150 and a second predetermined distance (y) above the restraint's bottom surface 152.

The first predetermined distance x is the distance below the restraint's top surface 150 wherein the restraint 110, 120 during the normal operating mode performs as a restraint as illustrated in FIG. 12, and simultaneously provides lateral stability to make the restraint/cushioning system 100 easier for the patient to get in and out of bed and facilitating patient transfers during the maximum inflate mode as illustrated in FIGS. 11 and 13. FIG. 13 illustrates that a second cushioning section 121 can be positioned below the cushioning section 120. The second cushioning section 121 can be an inflatable bladder, a gelastic material, foam, foam beads or equivalents thereof.

That first predetermined distance x is not near or at the restraint's top surface 150 because that creates a hammock effect which is undesired for reasons set forth in the background of the invention and inhibits the restraint from performing as a restraint. The first predetermined distance x is also not near the restraint's bottom surface 152 because then the desired lateral stability is not obtained for patient transfer. That means the first predetermined distance x ranges from about three inches below the restraint's top surface 150 and the first predetermined distance x does not enter into the range of the second predetermined distance y.

The second predetermined distance y is an area in which if the attachment 99 is positioned the bladders 122 and the restraint 110, 120 do not provide the desired lateral stability in the maximum inflation mode. There is a balance between lateral stability during maximum inflation mode and restraint capabilities during normal operating mode. Balancing those two issues have not been addressed in the past until now.

The restraint capability has to be obtained. It has been determined that about 3 inches is a minimum length for the first predetermined distance x. The minimum about three inches allows the restraint 110, 120 to provide the desired restraint characteristics during normal operating mode—inhibiting a patient from rolling off the cushion 120 (and possibly falling off the bed configuration and/or falling between the cushion and the bed configuration's railings 18 (item 18*a* illustrates an embodiment when the railing 18 is lowered.)

When the restraint is 5 inches high, the cushion 120 is the minimum 5 inches high and the first predetermined distance x for the attachment 99 between the cushion and the restraint is at a minimum about three inches; the restraint and the cushion provides the desired stability for transferring a patient during maximum inflate mode; and the restraint provides the desired restraint characteristics during normal operating mode.

In an alternative embodiment, the cushioning section 120 may be comprised of multiple side-by-side bladders 122 as illustrated in FIGS. 8 and 9 which are attached to each other, for example, by heat welding.

In another embodiment of the present invention, the cushioning section 120 may include a plurality of pin holes or micro-vents in its top surface 124 to produce a gentle flow of air beneath the user and to minimize moisture build-up.

In yet another alternative embodiment of the present invention, the cushioning section 120 may be of the alternating pressure type, i.e., it has at least two series of alternating cells, which are alternately inflated and deflated, one series of cells being inflated while the other series of cells is deflated. Such alternating pressure type cushions are disclosed, for example, in U.S. Pat. Nos. 5,794,289 and 5,901,393, which are hereby incorporated by reference in their entirety.

There have also been provided cushion and pump combinations in which alternate air chambers are alternately inflated and deflated to relieve excess pressure on patients at risk of developing pressure ulcers or to relieve excess pressure on patients with pressure ulcers (e.g., the Airflo Alternating Pressure System from Gaymar Industries, Inc.). Micro-vents and/or low air loss tubes may also provided to produce a gentle flow of air beneath the patient to help minimize moisture build-up.

In a further embodiment of the present invention, the cushioning section 120 may include a device for measuring the internal pressure of the cushioning section 120. Typically, such devices activate a light when the internal pressure of the cushioning section 120 is below a certain level, indicating a bottoming condition. The device may be integrated into the valve through which fluid is being fed into the cushioning section 120. Such devices are well known in the art and are described, for example, in U.S. Pat. No. 5,140,309, which is hereby incorporated by reference in its entirety.

Rotating the patient on an inflatable mattress is also a well known method to avoid bed sores on immobile patients. Such a method is disclosed, for example, in U.S. Pat. Nos. 5,794,289 and 6,079,070which are commonly assigned and incorporated by reference.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A cushioning device comprising:

a first deep cell inflatable bladder, a minimum five inches in height, having a first side, a second side, an upper surface and a lower surface, a first restraint structure having a top surface and a bottom surface and defines the exterior perimeter of a plurality of first deep cell inflatable bladders wherein the upper surface, when at a maximum inflation, and the top surface are on or within an approximation of the same plane and a patient positioned on the cushioning device contacts, excluding a conventional medically acceptable cover material, the first deep cell inflatable bladder and/or the first restraint structure;

a pump having (a) a maximum inflation mode that inflates each of the plurality of the first deep cell inflatable bladders so each bladder's entire upper surface and the first restraint's top surface are in the same plane and (b) a normal operating inflation mode that provides sufficient inflation to (A) prevent the first deep cell inflatable bladder's upper surface from contacting the first deep cell inflatable bladder's lower surface, (B) decrease (i) the formation of debuticus ulcers on a patient and (ii) the patient's tissue interface pressure, and (C) allow the first restraint structure to inhibit and/or restrain the patient from rolling off the first deep cell inflatable bladder;

an attachment that attaches at least a portion of the first deep cell inflatable bladder's first side to the first restraint structure at a predetermined distance (a) of 3 inches or greater below the first restraint's top surface and the first deep cell inflatable bladder's upper surface when inflated to maximum inflation mode, and (b) greater than zero inches above the first deep cell inflatable bladder's lower surface and the first restraint's bottom surface so (A) the first restraint during the normal operating mode inhibits and/or restrains the patient from rolling off the first deep cell inflatable bladder, and (B) the first restraint and first deep cell inflatable bladder provide lateral stability to allow the patient to get in and out of the cushioning device and facilitating patient transfers during the maximum inflate mode.

2. The cushioning device according to claim 1, wherein the first restraint structure is comprised of a fluid, a foam material, foam beads, gel, or batting.

3. The cushioning device according to claim 1 comprising a second restraint structure attached to a portion of the first cushion's second side.

4. The cushioning device according to claim 1, wherein the cushioning device is positioned over a long term support device having a railing.

5. The cushioning device according to claim 1, wherein the inflatable bladder further comprises: a plurality of micro-vents in the upper surface of the inflatable bladder.

6. The cushioning device according to claim 1 further comprising: a pressure sensing device operably connected to the inflatable bladder.

7. The cushioning device according to claim 1 comprising a second deep cell inflatable bladder that is adjacent to the first deep cell inflatable bladder.

8. The cushioning device according to claim 7 wherein the first deep cell inflatable bladder and the second deep cell inflatable bladder are attached.

9. The cushioning device according to claim 7 wherein the first deep cell inflatable bladder and the second deep cell inflatable bladder are alternately inflated and deflated.

10. The cushioning device according to claim 1 wherein the predetermined distance below the first restraint's top surface is at a minimum about three inches.

11. A method for restraining a user on a cushioning device comprising:

positioning a cushioning device on a supporting structure, the cushioning device comprising a first deep cell inflatable bladder, a minimum five inches in height, having a first side, a second side, an upper surface and a lower surface, a first restraint structure having a top surface and a bottom surface and defines the exterior boundary of a plurality of first deep cell inflatable bladders, wherein the upper surface, when at a maximum inflation, and the top surface are on or within an approximation of the same plane and a patient positioned on the cushioning device contacts, excluding a conventional medically acceptable cover material, the first deep cell inflatable bladder and/or the first restraint structure, a pump having (a) a maximum inflation mode that inflates each of the plurality of the first deep cell inflatable bladders so each bladder's entire upper surface and the first restraint's top surface are in the same plane and (b) a normal operating inflation mode that provides sufficient inflation to (A) prevent the first deep cell inflatable bladder's upper surface from contacting the first deep cell inflatable bladder's lower surface, (B) decrease (i) the formation of debuticus ulcers on a patient and (ii) the patient's tissue interface pressure, and (C) allow the first restraint structure to inhibit and/or restrain the patient from rolling off the first deep cell inflatable bladder;

an attachment that attaches at least a portion of the first deep cell inflatable bladder's first side to the first restraint structure at a predetermined distance (a) of 3 inches or greater below the first restraint's top surface and the first deep cell inflatable bladder's upper surface when inflated to maximum inflation mode, and (b) greater than zero inches above the first deep cell inflatable bladder's lower surface and the first restraint's bottom surface so (A) the first restraint during the normal operating mode inhibits and/or restrains the patient from rolling off the first deep cell inflatable bladder, and (B) the first restraint and first deep cell inflatable bladder provide lateral stability to allow the patient to get in and out of the cushioning device and facilitating patient transfers during the maximum inflate mode;

operating the pump to position the first deep cell inflatable bladder's upper surface in relation to the restraint's top surface into a desired position.

12. The method for a cushioning device according to claim 11, wherein the first restraint structure is comprised of a fluid, a foam material, foam beads, gel, or batting.

13. The method for a cushioning device according to claim 11 comprising a second restraint structure attached to a portion of the first cushion's second side.

14. The method for a cushioning device according to claim 11, wherein the cushioning device is positioned over a long term support device having a railing.

15. The method for a cushioning device according to claim 11, wherein the inflatable bladder further comprises; a plurality of micro-vents in the upper surface of the inflatable bladder.

16. The method for a cushioning device according to claim 11 further comprising: a pressure sensing device operably connected to the inflatable bladder.

17. The method for a cushioning device according to claim 11 comprising a second deep cell inflatable bladder that is adjacent to the first deep cell inflatable bladder.

18. The method for a cushioning device according to claim 17 wherein the first deep cell inflatable bladder and the second deep cell inflatable bladder are attached.

19. The method for a cushioning device according to claim 17 wherein the first deep cell inflatable bladder and the second deep cell inflatable bladder are alternately inflated and deflated.

20. The method for a cushioning device according to claim 11 wherein the predetermined distance below the first restraint's top surface is at a minimum about three inches.

* * * * *